US005232106A

United States Patent [19]

Hawthorne et al.

[11] Patent Number: 5,232,106

[45] Date of Patent: Aug. 3, 1993

[54] RAILWAY DRAWBAR WITH FABRICATED SECTION

[75] Inventors: V. Terrey Hawthorne, Lisle; Horst T. Kaufhold, Aurora, both of Ill.

[73] Assignee: Amsted Industries Incorporated, Chicago, Ill.

[21] Appl. No.: 908,051

[22] Filed: Jul. 6, 1992

[51] Int. Cl.[5] ..... B61G 9/20

[52] U.S. Cl. ..... 213/62 R

[58] Field of Search ..... 213/62 R, 62 A, 63, 213/64, 65, 66

[56] References Cited

U.S. PATENT DOCUMENTS

| | | | |
|---|---|---|---|
| 257,753 | 4/1904 | King | 213/62 R |
| 1,107,929 | 8/1914 | Garrett | 213/62 R |
| 3,709,376 | 1/1973 | Altherr | 213/62 R |
| 4,420,088 | 12/1983 | Metzger | 213/50.5 |
| 4,422,557 | 12/1983 | Altherr | 213/62 R |
| 4,456,133 | 6/1984 | Altherr | 213/62 R |
| 4,545,304 | 10/1985 | Brodeur et al. | 213/62 R |
| 4,580,686 | 4/1986 | Elliott | 213/62 R |
| 4,589,558 | 5/1986 | Brodeur et al. | 213/50 |
| 4,593,827 | 6/1986 | Altherr | 213/50 |
| 4,700,853 | 10/1987 | Altherr et al. | 213/50 |
| 5,000,330 | 3/1991 | Kaim et al. | 213/62 R |

FOREIGN PATENT DOCUMENTS

| | | | |
|---|---|---|---|
| 1047660 | 12/1958 | Fed. Rep. of Germany | 213/62 R |
| 0233978 | 3/1986 | Fed. Rep. of Germany | 213/62 R |

*Primary Examiner*—Mark T. Le

*Attorney, Agent, or Firm*—Edward J. Brosius; F. S. Gregorczyk; Thomas J. Schab

[57] ABSTRACT

A railway car with a slackless drawbar arrangement for unit trainservice and the like is provided and includes a drawbar having a section which is fabricated. The fabricated intermediate section is cut from a section of seamless pipe or tubing or can be fabricated from plate, while the coupling end pieces attached to each end of the shank are cast members made from typical casting methods. The coupling end pieces can be cast into standard fixed or rotatable drawbar ends or even be a combination thereof with rotational capability. The geometric shape of the intermediate section is varied, depending upon the application, so that resistance to torsional or bending loads is maximized. The fabricated shank portion is hollow, as well as part of the body of the coupling end pieces, thereby reducing the railcar's weight and costs to manufacture.

13 Claims, 3 Drawing Sheets 42
56
50
54
40
4
48
36
24
16
B
4A
12

RAILWAY DRAWBAR WITH FABRICATED SECTION

FIELD OF INVENTION

The present invention relates to railway car underframes and more particularly to a combination fabricated/cast drawbar which is particularly suitable for coupling extra long railcars.

BACKGROUND OF THE INVENTION

Drawbars are typically used to semi-permanently connect units of rail cars together as a single long train of cars when the cars have a fixed-use application such as transporting coal, ore, grain and the like, the units usually being comprised of five or ten cars per set. In those types of applications, drawbars replace conventional E and F type couplers which are used to detachably couple cars that have a single unit application.

More particularly, rotary drawbars permit multiple unit commodity trains to be emptied at an unloading station by rotating the entire car while it remains connected to the next awaiting car. The full-car dump practice is accomplished by using a drawbar connecting arrangement where the cars in each unit set have a fixed end connection on one end of the drawbar and a rotary connection on the other end. This type of car coupling arrangement alternates between each successive car in the unit. The rotatable coupling connector can either be a typical spherically shaped butt end head or it can be a standard F type coupling member with rotational capabilities. The fixed end is typically a vertically or horizontally pinned standard drawbar butt head. The prior art is replete with the various types of drawbar arrangements having different types of butt end heads, the drawbars almost invariably being of the slackless type. Variations of the types of slackless drawbars described above are illustrated in U.S. Pat. Nos. 5,000,330, 4,700,854, 4,593,827, 4,580,686, 4,456,133, 4,420,088. None of these patents disclose the principles of the present invention.

In the unloading process, an on-site rail car indexer and positioner electronically senses or indexes the car coupling device and then, depending upon the specific area of the coupling the indexer is programmed to encounter, positions an index mounted pusher arm for embracement with a designated point on the car coupling arrangement. Once embraced, the indexing car moves the entire car unit towards the unloading station, the first car in the unit being placed in the correct unloading position on the dumping platform. Because a drawbar shank does not have the structural coupling head features of E and F type couplers, drawbar shanks must be cast with generic E and F coupling head features so that the indexer can be tricked into thinking it has located and indexed a type E or F coupler head for purposes of setting the pusher arm. In this way, an entire train of cars can be unloaded without requiring the entire train of cars to use the same type of coupling heads.

When the cars are utilizing other unloading schemes such as bottom dump cars in combination with shakeout houses, the drawbar coupling arrangement of each unit usually consists of cars coupled together with both ends fixed by either vertically or horizontally pinned arrangements like those found in U.S. Pat. No. 4,700,853 or U.S. Ser. No. 568,773, allowed Oct. 21, 1991.

One problem common to all drawbars is that most of their connection parts are cast as either a single casting integral with the drawbar itself, or because of their complexity, are cast as separate coupling members from the main drawbar intermediate section, and are later welded together. Furthermore, the long, slender shape of a single integral casting is not an optimum shape to produce since casting is an expensive method of manufacturing. Another problem facing drawbar manufacturers is that railcar manufacturers are building longer cars due to economic reasons associated with hauling. The longer cars require drawbars of longer lengths to safely allow successful horizontal cornering of the car or else the probability of derailment is greatly increased. The longer drawbars can become a manufacturing problem for the suppliers because the overall drawbar length may exceed the flask capacity of a particular manufacturer's operation. The flask capacity is the volumetric size of the casting tundish. If the tundish cannot hold the amount of molten metal needed to cast the longer drawbars, it cannot be made, creating lost opportunities. Furthermore, even if a supplier has adequate flasking capacities, each time a new drawbar of a different length is made, a new casting mold must also accompany the new length. This aspect of manufacturing an entirely cast drawbar of varying lengths makes the casting process extremely expensive. Nevertheless, because of the high costs associated with casting even the standard length drawbar arrangements, the drawbar is a high cost item of a railcar underframe.

On the otherhand, casting of drawbars and coupling systems does have one main advantage over fabrication, namely, the ability to more easily produce the complex end pieces, whether they are special butt end heads or F-type butt end heads.

SUMMARY OF THE INVENTION

Accordingly, one object of the present invention is to provide a method of producing a combination cast/fabricated drawbar which utilizes a completely fabricated intermediate shank section, while the more complex coupling end pieces remain either as an entire casting or are a combination cast/fabricted section. In this way, the economic and manufacturing advantages of each material can be optimized.

It is another object of the present invention to produce drawbars of any desired length, regardless of limitations upon casting flask capacity.

It is an associated object of the invention to reduce the weight of the car by providing a lighter drawbar arrangement while simultaneously maintaining the safety, strength, durability, and convenience of assembly of drawbar arrangements which are entirely cast.

DESCRIPTION OF THE PREFERRED EMBODIMENT

Figure 8:
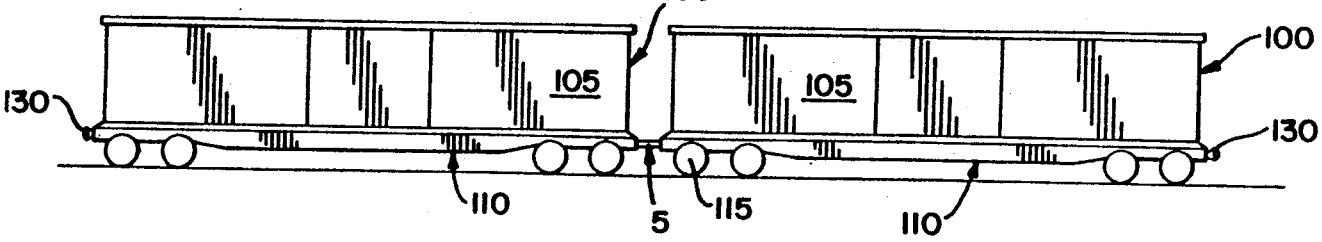
FIG. 8 is side view of a two-car unit of railway cars connected by a drawbar structure of the present invention.

With reference now to the drawings, FIG. 8 discloses a pair of railway cars 100 including car bodies 105 carried on underframes 110 supported on conventional car trucks 115. The front and rears of the cars 100 are provided with conventional couplers 130, whereas the intermediate ends of the car are interconnected by a drawbar 5.

Figure 1:
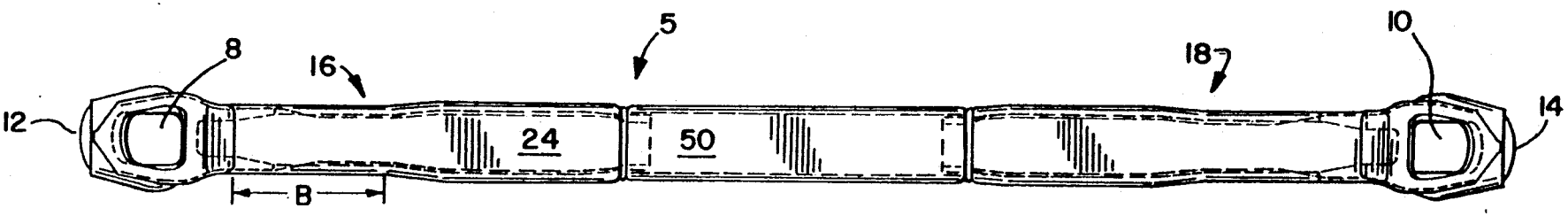
FIG. 1 is a top view of a dual ended vertically pinned drawbar showing the fabricated intermediate center section.
Figure 2:
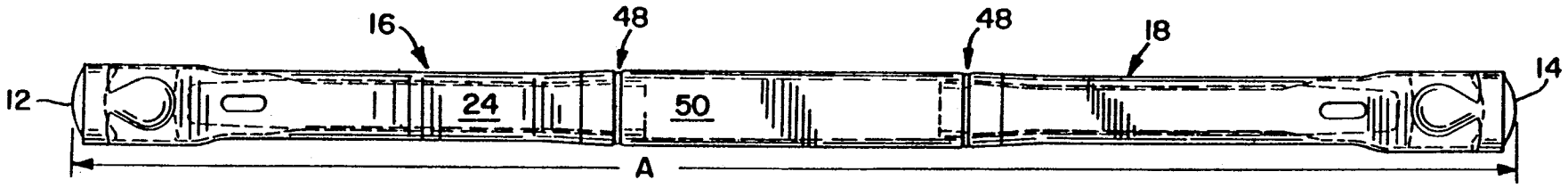
FIG. 2 is a side view of the drawbar shown in FIG. 1.

With reference now to FIGS. 1, 2 and 8, drawbar 5 is shown as a standard fixed end drawbar which includes vertical openings 8,10 on each butt end head 12 and 14. A pin member (not shown) inserted through openings 8 and 10, secures drawbar 5 to the center sill 110 of railcar 100 (not shown).

The drawbar 5 consists of an elongated intermediate shank portion 50, which is a fabricated member, with cast end coupling pieces 16 and 18 attached to each end. Shank portion 50 is considered as being fabricated in that it can either be a section of heavy gauge square, rectangular, or round seamless tubing, or a like equivalent. In any event, shank portion 50 can be fabricated into any geometric shape as long as by known engineering principals, it can withstand encountered forces such as bending, twisting, shearing, tension or compression. For example, a piece of square tubing for shank portion 50 would be used when all railcars 100 which are being pulled, are interconnected soley by drawbar so as to form a single "unit" of cars, typically about five or ten joined cars, having a fixed use which experiences only longitudinal buff and draft forces. On the other hand, a car coupling arrangement as shown in FIG. 8 would typically be adapted for use in a car dumping station application. Coupling member 130, connecting each individual car of the "unit", would be a rotatable coupling member so that each individual car 100 can be overturned to unload the contents of the car. If more than one "unit" is being pulled, the units would be joined by drawbar 5. In the dumping application, torsional forces are present and shank portion 50 would best be made into a circular shape, since by known engineering principals, that shape resists torsional forces much better than a non-circular shape. In carrying out the present invention, the intermediate shank portion 50 can be fabricated to any desired length so that a drawbar of any length A, as seen in FIG. 2, can be constructed.

Figures 3, 3A, 4, 4A, 5:
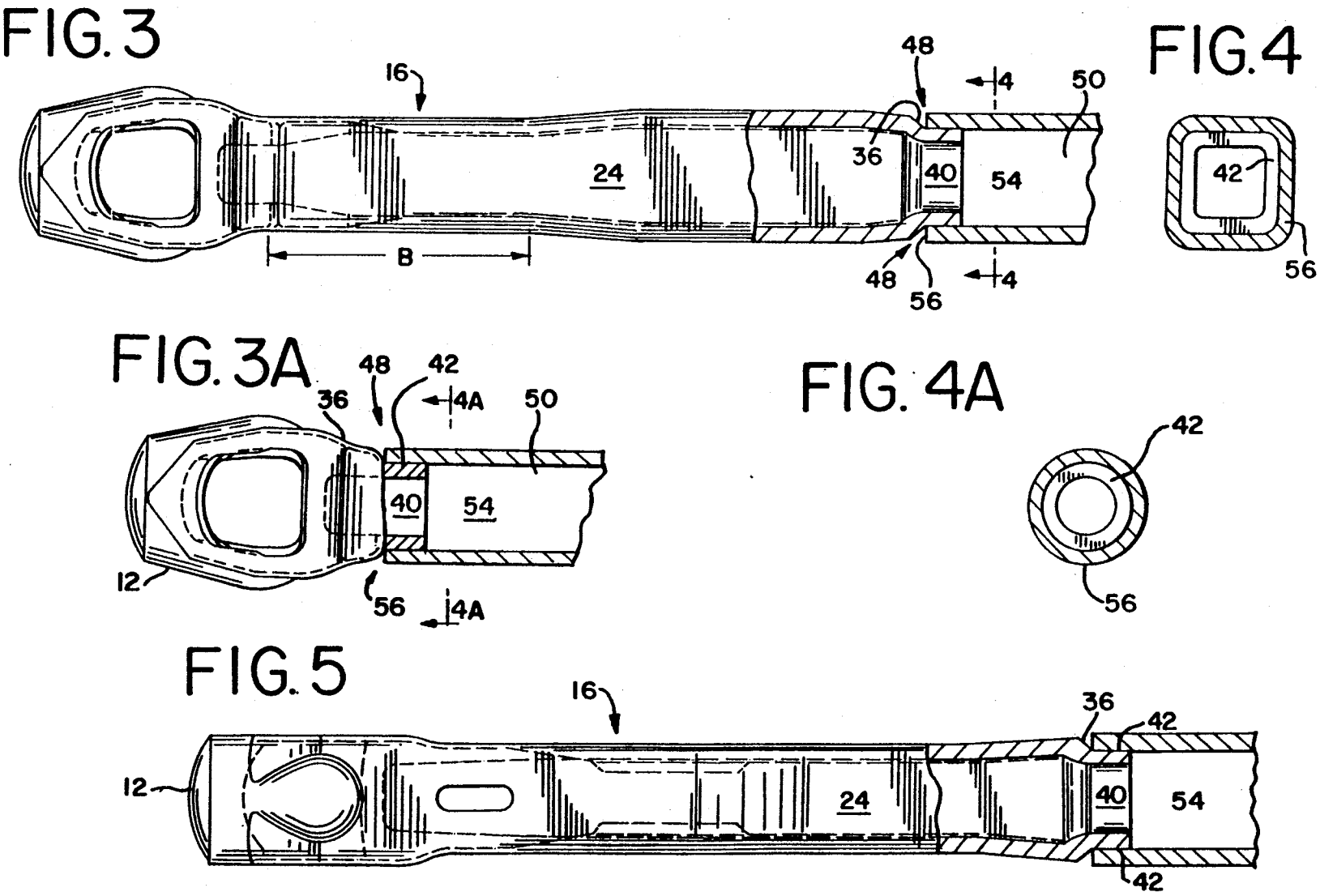
FIG. 3 is a fragmentary top view of a cast coupling end piece of a standard vertically pinned fixed end drawbar connected to a fragment of a rectangular intermediate section.
FIG. 3A is a fragmentary top view of a cast coupling end piece connected to a fragment of a round intermediate section, only the butt end head being cast.
FIG. 4 is a end view of the drawbar shown in FIG. 3.
FIG. 4A is an end view of the drawbar shown in FIG. 3A.
FIG. 5 is a fragmentary side view of the coupling end piece and intermediate section shown in FIG. 3.
Figure 6:
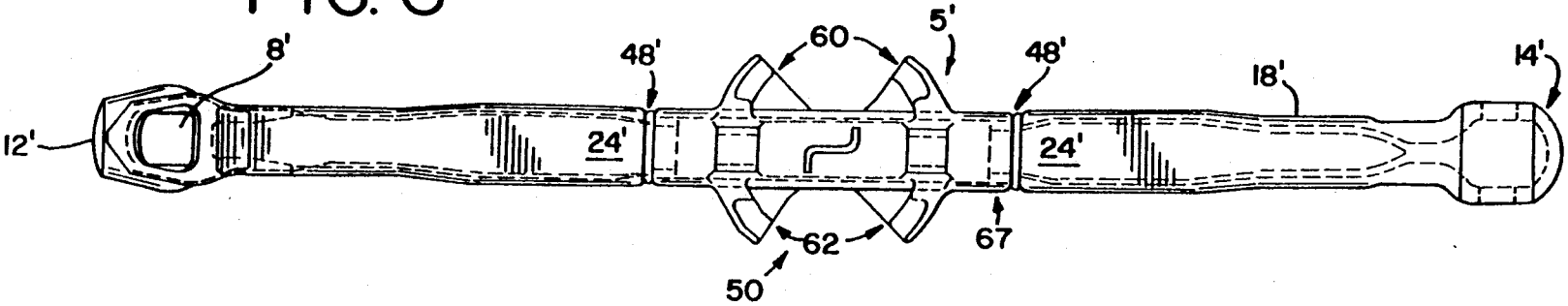
FIG. 6 is a top view of a drawbar of the present invention adapted for use in a rotary dump operation were one end is fixed and the other is rotational. The intermediate section contains generic coupling features for use with an automatic indexing and positioning machine.
Figure 7:
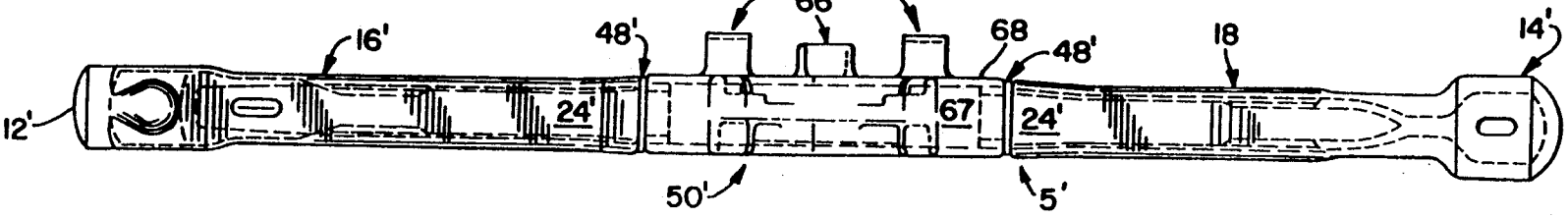
FIG. 7 is a side view of the drawbar shown in FIG. 6.

Referring now to FIGS. 3–5, the more complicated coupling end pieces 16 and 18 of drawbar 5 can either remain as a single unitary casting, or can be made into a combination of cast/fabricated sections, as will be described shortly. In the embodiments shown, both end pieces 16,18 consist of a single unitary casting, including the butt end heads 12,14 on each end of drawbar 5. Since cast end pieces 16,18 are identical to each other, only end piece 16 will be described. Nevertheless, it should be understood that although each end piece 16 and 18 are shown as being identically constructed, butt end heads 12 and 14 do not necessarily have to be identical to each other. It is the actual field applications that dictate what butt end heads are to be used and this condition is seen in FIGS. 6 and 7, which will be described later.

Referring again to only end piece 16 in FIGS. 3–5, although butt end head 12 is of standard construction and will always be an entirely cast piece, body 24 can be constructed such that it is entirely cast, or can have only a portion of its body cast. The only limitation is that whatever geometric shape is chosen for construction of intermediate shank portion 50, that same shape must be maintained on the very end, or sleeve portion 40, of body 24. This means that it is possible for body 24 not to be cast into the same geometric shape which was chosen for intermediate shank portion 50. For instance, if the drawbar application was known to be used for non-rotary dumping, the intermediate shank portion 50 would be made of a rectangularly shaped fabrication because by known engineering principals, the rectangular piece would resist the bending loads much better than a round section. But, if it is known that the same drawbar will be used in a dumper operation where torsional forces during dumping operation are predominant, a rounded body 24 would ideally be desired because it is known that round sections better resist torsional forces compared to rectangular ones. It is also known to those in the art that the torsional forces encountered during this type of unloading process are most critical only on a specific part of drawbar 5. In particular, that critical section is indicated on body 24 as length B. Therefore, it is possible to match the types of forces encountered along the entire length of drawbar 5, to the ideal structural piece which best resists those forces. Conceivably, body 24 could be constructed so that only length B on body 24 is of a round structural section, whether fabricated or cast. In the embodiment shown, body 24 is of a single structural design and construction; body 24 is entirely cast and entirely of a single shape which matches shank portion 50. If body 24 was of a shape different to that of shank portion 50, body 24 would then require that the reduced sleeve portion 40 be the only part constructed with a complementary piece to that of intermediate shank portion 50 so that the two sections can be easily joined. Conceptually, if only the but end heads 12,14 were to be cast, the casting would still contain the reduced sleeve portion 40 attached directly to the butt end head, while the length of the fabricated shank portion 50 would be increased, thereby displacing the need for an actual body portion 24, as shown in FIGS. 3A and 4A.

The preferred construction of drawbar 5 is to greatly reduce costs of manufacture and the weight of the drawbar by only making butt end 12 from a casting, while fabricating the rest of drawbar 5, as shown in FIGS. 3A and 4A. However, for demonstrative purposes only, it is to be understood that FIGS. 3–7 will be referring to a drawbar which has an entirely cast end piece 16 that is of the same geometric shape as shank portion 50, and that the only fabricated section will be intermediate shank portion 50. In FIG. 3, body 24 of end piece 16 is shown as a cast rectangular section which, due to the particulars of casting, has a slightly outwardardly flared body from start of length B to the transitional ledge 36. Ledge 36 represents a transitional zone or area between central body 24 and reduced sleeve portion 40. Transitional ledge 36 is downwardly angled to allow sleeve portion 40 to fit into shank portion 50. Reduced sleeve portion 40 must be a shape which is complementary to that of hollow end 54 of intermediate shank portion 50 or else the final joint between the two pieces will not have enough integrity to withstand normal operating forces. In particular, sleeve portion 40 has outer walls 42 which are complementary to the geometric shape of intermediate shank portion 50 and which are specifically designed to act as a tennon in a mortise, thereby forming joint 48 when outside walls 42 of sleeve portion 40 are slid into hollow end 54 of shank portion 50 to the point where truncated end 56 of shank 50 touches transitional ledge 36 on end piece 16. The mortise joint 48 thereby formed is superior in strength and integrity to a joint which could be formed by merely butting a complemetarily shaped and sized end piece 16 against shank portion 50, and then welding the two pieces together. It is to be understood that in the embodiment shown, body 24 and sleeve portion 40 are hollow, and the only solidly cast piece is butt end head 12 and its associated components. By casting this section hollow, manufacturing costs and drawbar weights can be lowered.

Once reduced sleeve portion 40 of cast end piece 16 is slid into the hollow end 54 of shank portion 50, both pieces are secured together, preferably by welding along the entire perimeter of joint 48, although other methods such as keying or bolting can be used. It is important that the welding of the drawbar sections 16,18 and 50 proceed in a specific fashion because the structural integrity of the drawbar can be effected otherwise. Moreover, whether end piece 16 and intermediate shank portion 50 are either rectangular or round will make assembly procedures proceed slightly differently. In either application, it is important to begin assembly by preheating approximately a two inch area along each side of joint 48 to a temperature of about 250° F. before welding begins. The preheating prior to welding will reduce the stresses introduced by the welding process. Once temperature is reached, welding can now proceed. If both the end piece sections 16,18 and the shank portion 50 are rectangular, opposite corners of the rectangularly shaped joint 48 should be tack welded into place first. By proceeding in opposite corners, the joint can be checked so that end pieces 16,18 are level with respect to the shank and do not curl upward from the welding process. If the components are round sections, then tack welding proceeds in a similarly spaced method, as would be known to those experienced in welding. Once the tacking of each end piece 16,18 is secured and levelled with respect to shank portion 50, the first pass of weldment can be applied completely around the perimeter of the structure, namely, entirely around joint 48. As each pass is applied, the weldment is being allowed to air-cool in the time period before the next complete pass of weldment is applied. This is favorable and preferred since it is also possible to quench cool each and every pass. However, quench cooling would require the finally-assembled drawbar to be heat treated, or annealed, for stress relief. Under the preferred method of construction, annealing is not required because once the next pass is applied, the heat generated during welding anneals the previous pass, thereby relieving the stresses induced into the joint by the welding process. Preferably, the final pass is stress relieved by shot peening, since large annealing furnaces required as a result of constructing the extra-long drawbar lengths might not be available. If they are available, quenching inbetween the passes of weldment could be performed and the final product annealed in the furnace. However, the preferred method of annealing is faster and cheaper. At a very minimum, at least two passes should be applied and it is preferable to apply at least five passes in order to guarantee structural integrity from the high forces encountered during use.

In a second embodiment, shown in FIGS. 7 and 8, the general features of the first embodiment are maintained, except drawbar 5' shows cast end piece 16' as having a fixed drawbar butt end head 12', while cast end piece 18' is shown as having a rotary but end head 14'. This particular embodiment will be encountered when a train of cars has a dedicated service such as coal transport, where the cars must be adaptable to the unloading equipment at the processing facility. In a facility such as a power plant or a steel mill, the railcars 100 are usually unloaded by rotating the entire car into an upside down position over a fixed unloading chute or bin. In that situation, rotary butt head end 14' permits the car in the unloading station to be unloaded while still connected to the adjacent car even though the other drawbar end piece 16' has a fixed butt end head 12'. Moreover, in the unloading process, an on-site railcar indexer/positioner (not shown) electronically senses the railcar coupler, and by using that point as a reference, positions a pusher arm outwards for embracement with either the coupler or a designated point on the railcar itself. Once embraced, the car can now be pushed to the correct location within the unloading station. Because a typical drawbar shank like the one shown in FIGS. 1 and 2 will not work with an indexer which references off coupler heads, drawbar 5' is fabricated with the standard knuckle and coupler head features of a standard E or F type coupler. Ears 60 and 62, which project laterally from side wall 67 of shank portion 50' of drawbar 5', dimensionally represent the outside shape of two coupled type E or F couplers. Boss 64 which simulates the coupler horn line, and boss 66, which simulates the top of the knuckle both project vertically upwards from sidewall wall 67 are added to shank 50', simulate the coupler horn line to give the indexer/positioner a securing and pushing point when transporting the car into the unloading station. In this way, an entire train of cars can be unloaded without requiring the use of identical coupling end pieces if a drawbar is used instead of couplers. Bosses 64,66 and ears 60,62 are also fabricated pieces which are attached by welding, to shank portion 50'. As mentioned earlier, this particular embodiment is not limited to making the end piece 16' entirely from a casting, rather, this embodiment is emphasizing the point that in this particular application, the butt end head 12' is a cast member, while the remaining drawbar parts and sections in this embodiment are fabricated instead of cast.

What is claimed is:

1. A drawbar for connecting two railway cars, the improvement comprising:

an elongate fabricated metal intermediate shank portion having a generally geometrical shape, said shank including a first truncated end and a second truncated end, said shank portion defining a mortise-like hollow opening at each of said shank portion first and second truncated ends;

a first coupling end piece and a second coupling end piece, each of said first and second coupling end pieces having a butt end head and a coupling end, said coupling end including a means for mating, one of said first and second coupling end pieces connected to one of said shank portion first and second ends by said means for mating, and the other of said first and second coupling end pieces connected to the other of said shank portion first and second ends by said means for mating, said shank portion, said first coupling end piece, and said second coupling end piece forming said drawbar.

2. The drawbar of claim 1 wherein each of said coupling end pieces is a single casting.

3. The drawbar of claim 2 wherein the coupling end of each said coupling end piece is a coupling sleeve integrally formed with the butt end head of said each coupling end piece.

4. The drawbar of claim 1 wherein said intermediate shank portion is hollow.

5. The drawbar of claim 1 wherein said geometrically shaped shank is rectangular.

6. The drawbar of claim 1 wherein said geometrically shaped shank is round.

7. The drawbar of claim 1 wherein each of said coupling end piece mating means is comprised of a reduced sleeve portion complementary in shape to said mortise-like hollow opening on each of said shank truncated ends, said reduced sleeve portion defining a transitional, downwardly-angled ledge.

8. The drawbar of claim 7 wherein said reduced sleeve portion of each of said coupling end pieces is hollow.

9. The drawbar of claim 7, wherein one of said first and second coupling end piece mating means is mortised within one of said first or second shank end hollow openings and the other of said first and second coupling end piece mating means is mortised within the other of said first and second shank end hollow opening, such that each of said first and second coupling end piece transitional ledges touches said respective shank first and second truncated ends.

10. The drawbar of claim 1 wherein one of said first and second coupling end piece butt end heads allows said railcar to rotate.

11. The drawbar of claim 10 wherein said shank portion includes means for accepting a railcar positioner.

12. A method of constructing an improved railcar drawbar, said drawbar including an elongate fabricated metal intermediate shank portion having a generally geometrical shape, said shank portion including a first truncated end and a second truncated end, said shank portion defining a mortise-like hollow opening at each of said shank portion first and second truncated ends, a first coupling end piece and a second coupling end piece, each of said first and second coupling end pieces having a butt end head and a coupling end, said coupling end including a means for mating, comprising the steps of:

providing said first coupling end piece, said second coupling end piece and a shank portion, and aligning said shank portion in between each of said coupling end pieces in the horizontal plane;

sliding said mating means of each of said first and second coupling end pieces into said respective hollow openings of said intermediate shank portion first and second ends, until each of downwardly-angled ledges formed on said first and second end pieces touches said respective first and second truncated ends of said intermediate shank portion, thereby forming a first joint and a second joint;

preheating an area about two inches to each side of said first and second joints to about 250° F.;

securing each of said first and second coupling end pieces to said respective shank first and second ends by sequentially applying tack welding to opposing portions of each of said first and second joints, such that said intermediate shank portion first end and said first coupling end piece is level with respect to each other and said shank portion second end and said second coupling end piece is level with respect to each other;

allowing each of said joints to air cool after said tack welding is applied to each of said joints;

applying a first continuous pass of weldment around the entire perimeter of each of said first and second joints;

allowing each of said joints to air cool after said first continuous pass of weldment is applied;

applying a second continuous pass of weldment around the entire perimeter of each of said joints;

allowing each of said joints to air cool after said second continuous pass of weldment is applied;

applying at least a third continuous pass of weldment around the entire perimeter of said first and second joints; and allowing each of said joints to air cool after said third continuous pass of weldment is applied.

13. The method of claim 12 which further includes the step of stress relieving each of said joints.

* * * * *